US007921967B2

(12) United States Patent
Lara

(10) Patent No.: US 7,921,967 B2
(45) Date of Patent: Apr. 12, 2011

(54) ENERGY-ABSORBING DEVICE

(75) Inventor: Pascal Lara, Nice (FR)

(73) Assignee: Capital Safety Group EMEA, Carros Cedex (FR)

( * ) Notice: Subject to any disclaimer, the term of this patent is extended or adjusted under 35 U.S.C. 154(b) by 645 days.

(21) Appl. No.: 11/910,042

(22) PCT Filed: Mar. 29, 2006

(86) PCT No.: PCT/EP2006/061149

§ 371 (c)(1),
(2), (4) Date: Sep. 28, 2007

(87) PCT Pub. No.: WO2006/103259

PCT Pub. Date: Oct. 5, 2006

(65) Prior Publication Data

US 2008/0251320 A1 Oct. 16, 2008

(30) Foreign Application Priority Data

Apr. 1, 2005 (FR) ..... 05 50851

(51) Int. Cl.
*A62B 35/00* (2006.01)

(52) U.S. Cl. ..... 182/3; 182/45

(58) Field of Classification Search ..... 182/3, 45
See application file for complete search history.

(56) References Cited

U.S. PATENT DOCUMENTS

| | | | | |
|---|---|---|---|---|
| 3,087,584 A | | 4/1963 | Jackson et al. | |
| 3,965,543 A | | 6/1976 | Connors | |
| 4,558,584 A | | 12/1985 | Myers | |
| 4,790,410 A | | 12/1988 | Sharp et al. | |
| 4,978,139 A | | 12/1990 | Andres et al. | |
| 5,015,023 A | | 5/1991 | Hall | |
| 5,015,205 A | * | 5/1991 | Franks, Jr. | 439/803 |
| 5,297,651 A | | 3/1994 | Vandelinde et al. | |
| 5,400,868 A | * | 3/1995 | Ellis et al. | 182/18 |
| 5,458,214 A | | 10/1995 | Olson et al. | |
| 6,001,098 A | * | 12/1999 | Metz-Stavenhagen et al. | 606/264 |
| 6,076,236 A | | 6/2000 | DeFrance | |
| 6,338,399 B1 | | 1/2002 | Choate | |
| 6,425,458 B1 | | 7/2002 | Söll | |
| 6,516,920 B1 | * | 2/2003 | Schafler | 182/70 |
| 6,571,912 B2 | * | 6/2003 | Soll | 182/36 |

(Continued)

FOREIGN PATENT DOCUMENTS

EP 0 272 908 A2 6/1988

(Continued)

OTHER PUBLICATIONS

Flap n. 1. A flat, usually thin piece attached at only one side. The American Heritage® Dictionary of the English Language, Fourth Edition copyright © 2000 by Houghton Mifflin Company.

(Continued)

*Primary Examiner* — Alvin C Chin-Shue
(74) *Attorney, Agent, or Firm* — IPLM Group, P.A.

(57) ABSTRACT

An energy absorption device for a safety fixing system includes two sections capable of being set in relative motion with friction so that the device is able to absorb energy. The device has elements for adjusting the frictional force between the two sections. A safety fixing system incorporating the energy absorption device is also disclosed. The device maybe used in the safety systems that make use, in particular, of a life-line.

16 Claims, 5 Drawing Sheets

U.S. PATENT DOCUMENTS

| | | | | |
|---|---|---|---|---|
| 7,163,083 | B2 * | 1/2007 | Argoud | 182/113 |
| 2002/0073831 | A1 * | 6/2002 | MacLeon | 89/1.81 |
| 2002/0079164 | A1 * | 6/2002 | Choate | 182/36 |
| 2002/0134618 | A1 | 9/2002 | Timmermans | |
| 2003/0111310 | A1 | 6/2003 | Renton et al. | |
| 2003/0151180 | A1 | 8/2003 | Renton | |
| 2004/0193217 | A1 | 9/2004 | Lubbers et al. | |
| 2005/0033366 | A1 | 2/2005 | Cole et al. | |
| 2005/0034920 | A1 | 2/2005 | Anderson | |
| 2005/0146071 | A1 | 7/2005 | Tiemeier et al. | |
| 2005/0177022 | A1 | 8/2005 | Chu et al. | |
| 2006/0113147 | A1 * | 6/2006 | Harris, Jr. | 182/3 |
| 2007/0108345 | A1 * | 5/2007 | McDonnell | 244/110 C |
| 2008/0006750 | A1 * | 1/2008 | Flux | 248/231.9 |
| 2008/0156587 | A1 | 7/2008 | Lara | |
| 2008/0184534 | A1 | 8/2008 | Lara | |

FOREIGN PATENT DOCUMENTS

| | | | | |
|---|---|---|---|---|
| EP | 0 273 673 | A1 | | 7/1988 |
| GB | 2 336 617 | A | | 10/1999 |
| GB | 2354052 | A | * | 3/2001 |
| GB | 2 403 256 | A | | 12/2004 |
| WO | WO 93/06384 | | | 4/1993 |
| WO | WO 99/22816 | A | | 5/1999 |
| WO | WO 00/47285 | A | | 8/2000 |

OTHER PUBLICATIONS

International Search Report of PCT/EP2006/062544 mailed Jul. 28, 2006.

International Search Report of PCT/EP2006/062548 mailed Jul. 25, 2006.

* cited by examiner

A.A.

ENERGY-ABSORBING DEVICE

This invention relates to an energy absorption device as well as a safety fixing system equipped with this device.

The invention is intended for use particularly in the field of safety installations which use life-lines by means of which personnel working in dangerous conditions are able to steady themselves.

The invention relates more particularly to safety fixing systems that enable impacts, due mainly to people falling in accidents, to be absorbed.

In this field, a safety anchoring device incorporating an energy absorber is known from document WO-A-01/87420.

Because of the different settings it provides (release and frictional force) the invention makes it possible to limit the falling forces exerted both on the user and on the structure, according to the thickness of the support and its strength.

According to this state of the art the energy absorption is provided by the plastic deformation of a helical element.

The remanent deformation exerted on the helical element provides the absorption of the energy generated in the event of an impact.

One disadvantage associated with this type of device is that it gives rise to remanent deformation of the helical element, which makes it impossible to re-use.

Moreover, the level of damping cannot be controlled by this type of device.

A safety anchoring device comprising a shock absorber, formed classically by an assembly of threaded rods supporting a nut and capable of translating, with a high degree of friction in a sleeve, the relative friction of the threaded rod with the nut and of the sleeve to provide an energy absorption capable of damping impacts, is also known from document WO-A-03/039680.

As in the previous case, no control of the damping is possible according to this prior art.

Furthermore, when it is released, the shock absorber is degraded, which reduces the possibilities of re-using it.

This invention enables some or all of the disadvantages of the aforementioned devices to be eliminated, and presents for this purpose an energy absorption device for an improved safety fixing system.

More particularly, the device proposed here comprises two sections that can be set in relative motion with a friction to absorb at least some of the energy generated in the case of impacts.

Setting means are advantageously provided to adjust the frictional force between the two sections capable of being set in relative motion.

In this manner the device of the invention can easily be configured to the particular application for which it is to be used.

The system for setting the frictional force is preferably designed so that the frictional force is continuously adjusted either up or down.

This variation is also provided, in a preferred manner, by modifying the force of contact between the two sections, i.e. by modifying the supporting force applied by one of the sections to the surface of the other section.

According to an advantageous variant of the invention the energy absorption device also comprises fuse means so that the relative movement of the two sections can only be triggered beyond a certain predetermined force threshold (advantageously the predetermined force threshold is selected in relation to the predetermined frictional force).

This therefore prevents any untimely release of the energy absorption system.

According to a further preferred variant, the energy absorption device is incorporated in a safety fixing system assuming the general form of a post exhibiting a body capable of pivoting relative to a base, and enabling persons to be connected to it by means of a life-line or anchorage point.

Other purposes and advantages will be indicated in the course of the following description, which is given by way of information and is not exhaustive as far as the invention is concerned.

This invention relates to an energy absorption device for a safety fixing system, comprising two sections capable of being set in relative motion with friction so that it is able to absorb energy, characterised in that one section comprises two jaws capable of being applied to various points on the other section.

In the preferred embodiments, this occlusive device is such that:

- it comprises means for setting the frictional force between the two sections by varying the force of contact between the two sections.
- the distance between the jaws is adjustable by screwing.
- the other section comprises a portion of cable capable of being displaced between the jaws.
- the jaws are provided with a groove for guiding the portion of cable.
- the device comprises fuse means for triggering the relative movement of the two sections only beyond a predetermined force threshold.
- the fuse means are two fuse parts immovably attached to each other by means of a threaded connection, each of them being integral with a different section and configured so that the threaded connection is broken beyond the predetermined force threshold.
- the fuse parts have tearing strengths for different threads so that the breaking of the threaded connection is due to the tearing of the threads of a single fuse part.
- the fuse parts are of materials of different mechanical strength.
- at least one fuse part is replaceable.
- the fuse part having the lowest tearing strength of its threads is replaceable.

The invention also relates to a safety fixing system provided with an anchoring base on a reference surface and means of connection to a life-line, characterised in that it comprises an energy absorption device between the base and the means of connection.

According to preferred variants, this system is such that:

- the means of connection comprise a body mounted on the base and receiving the absorption device in its internal volume.
- the system comprises:
  - a first fuse part integral with the base and one end of the cable portion, the other end of the cable portion being integral with the body;
  - a frame supporting two jaws capable of being applied at various points on the cable portion to exert a contact force;
  - a second fuse part integral with the body and immovable attached to the first fuse part by a threaded fuse connection beyond a predetermined force threshold.
- the second fuse part is mounted replaceably on the frame and the tearing strength of its threads is lower than that of the threads of the first fuse part.

The appended drawings are given as an example and do not limit the invention. They represent only one embodiment of the invention and allow it to be easily understood.

The safety fixing system shown in the figures incorporates an energy absorption device comprising two sections capable of being set in relative motion with friction.

More particularly, in the case shown, the sections set in motion are a cable portion 5 on the one hand, and means 9*a*, 9*b* performing the function of a vice on the other.

Figure 1:
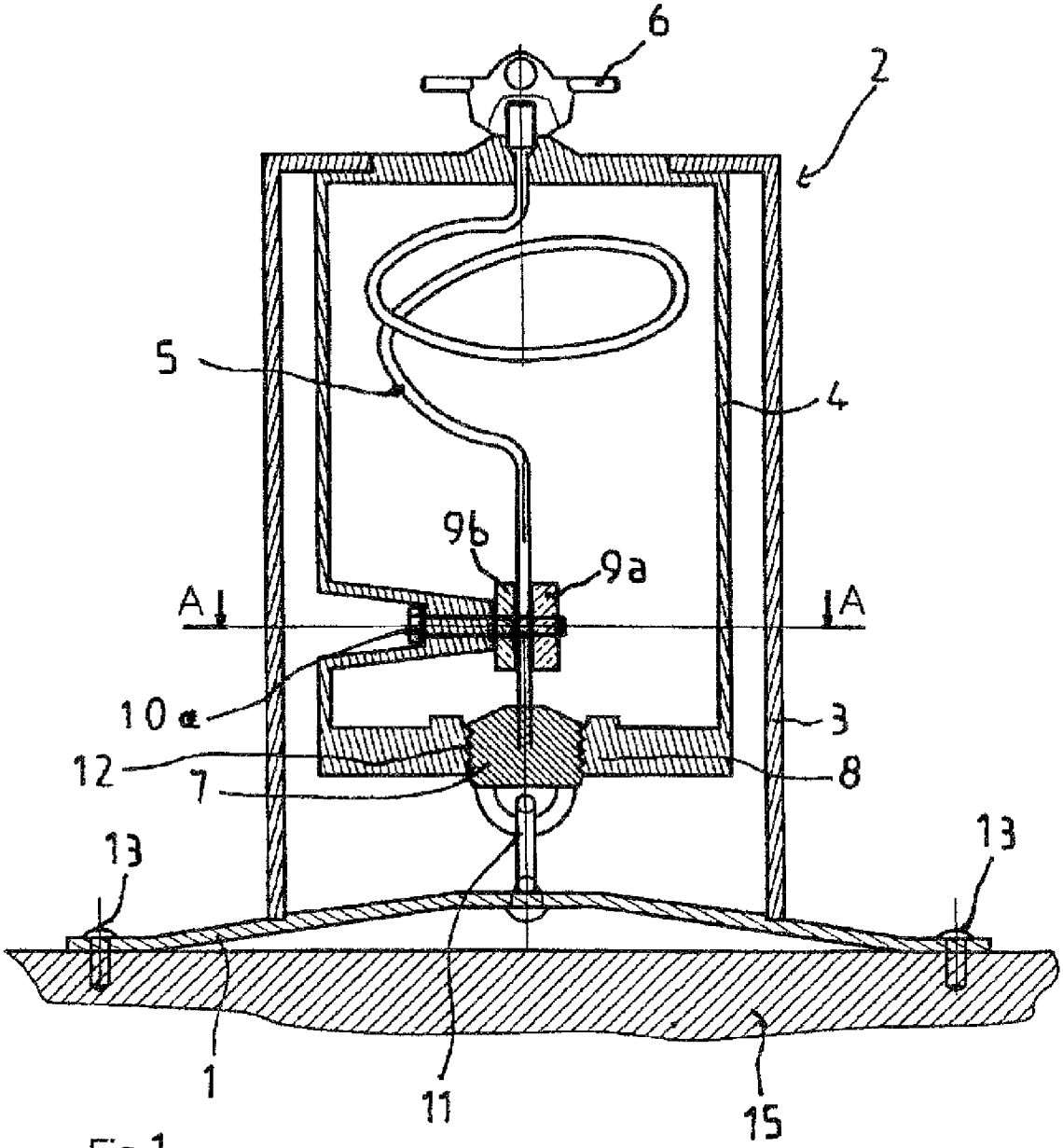
FIG. 1 is a longitudinal sectional view of a safety fixing system in an embodiment of the invention.
Figure 6:
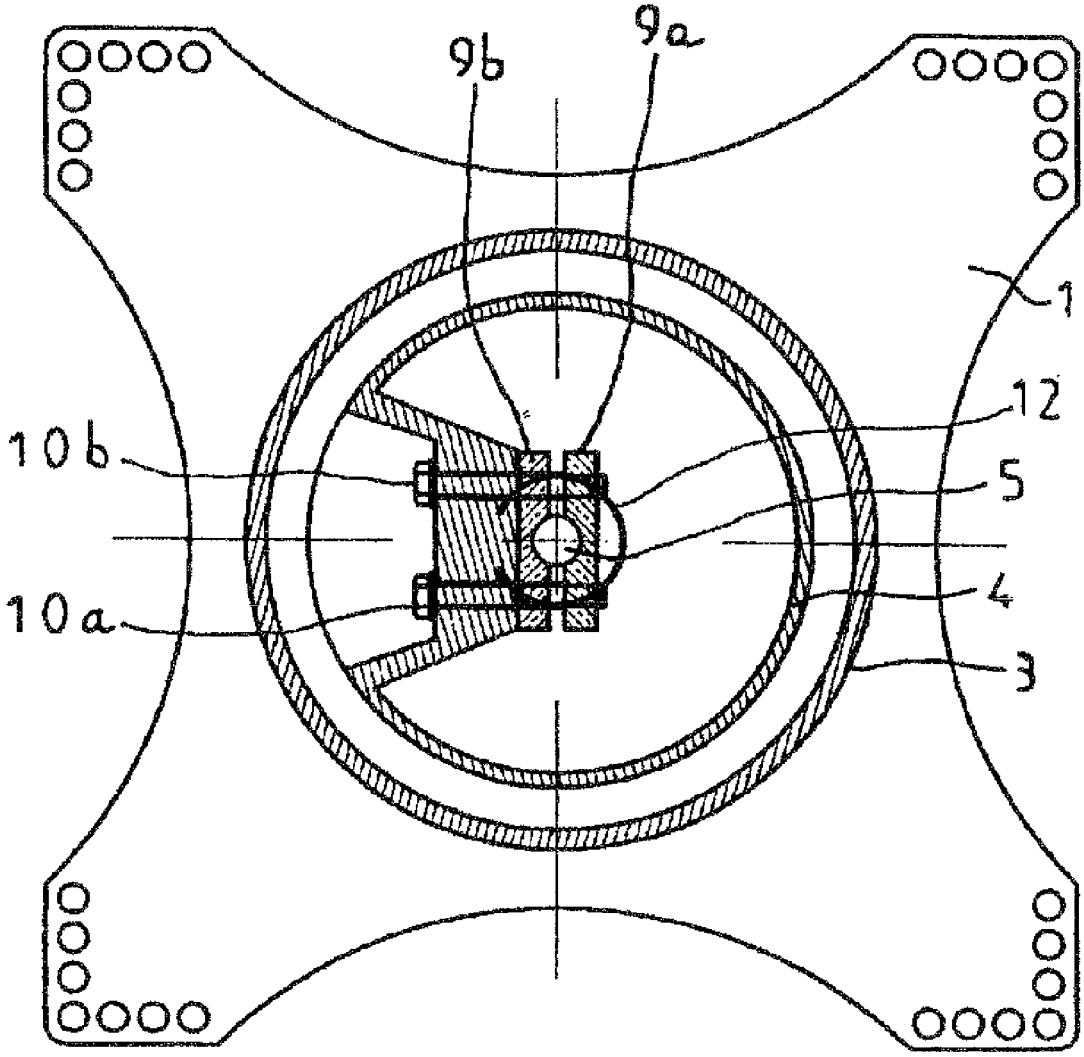
FIG. 6 is a sectional view along line A-A in FIG. 1.

In the case shown the frictional force between jaws 9*a*, 9*b* and cable portion 5 can easily be adjusted by means of screwing means 10*a*, 10*b*, for example screws that are shown in particular in FIGS. 1 and 6, so that jaws 9*a*, 9*b* are moved closer together or further apart to modify the force of contact between said jaws and cable portion 5.

The safety fixing system shown assumes the general form of a post provided with a base 1 capable of being fixed to a reference surface 15 (for example, a roof covering) by means of a plurality of screws 13 passing through holes shown, in particular, in FIG. 6.

Base 1 is mounted on a body 3 which constitutes the essential mechanism of means of connection 2 to a life-line 14. The life-line is connected by means of a ring 6 of conventional design.

Any means of connection of prior art between the system of the invention and a life-line 14 may be used without departing from the framework of the invention.

Body 3 is cylindrical in shape, for example, and defines an inner part receiving volume forming the energy absorption device.

In this context body 3 encloses a frame 4 which is immovably attached to body 3, e.g. by welding, frame 4 serving to support the vice formed by jaws 9*a*, 9*b*.

The upper end of cable portion 5 is embedded in body 3/frame 4 assembly, for example at the upper end of body 3.

The lower end of cable portion 5 is embedded in a part 7, itself immovably attached to base 1 by means of link assembly 11.

It will be noted that link assembly 11 provides a freedom of rotary movement of base 1 relative to part 7.

An intermediate section of cable portion 5, in the case shown close to part 7, is enclosed by jaws 9*a*, 9*b* to provide a relative force of contact capable of generating a friction when cable portion 5 is in motion relative to jaws 9*a*, 9*b*.

It will be noted that in the case shown a high residual volume exists inside body 3, which enables a long length of cable portion 5 to be stored.

In the lower section of frame 4 a threaded connection 12 enables part 7 to be assembled relative to frame 4.

In this context a second fuse part 8 is formed integrally with frame 4, with a threaded section capable of interacting with the threads of part 7 to provide the aforementioned connection 12.

According to the embodiment shown, the second fuse part 8 is formed in one piece with frame 4.

However, this part may be fitted as an addition, and advantageously so that it can be replaced.

A tearing strength of the threads for threaded connection 12 is selected so that it determines the release threshold of the energy absorption device.

Thus for any force lower than the threshold predetermined for threaded connection 12, the latter includes all the stresses and no relative movement is generated between jaws 9*a*, 9*b* and cable portion 5.

When this threshold is exceeded, for example in the case of a sudden impact due to the falling of a person, threaded connection 12 is destroyed, which provides a freedom of movement of cable portion 5 in jaws 9*a*, 9*b*.

The friction generated absorbs at least part of the energy due to impact.

FIGS. 2 to 5 show different phases of mobilisation of the absorption device.

Figure 2:
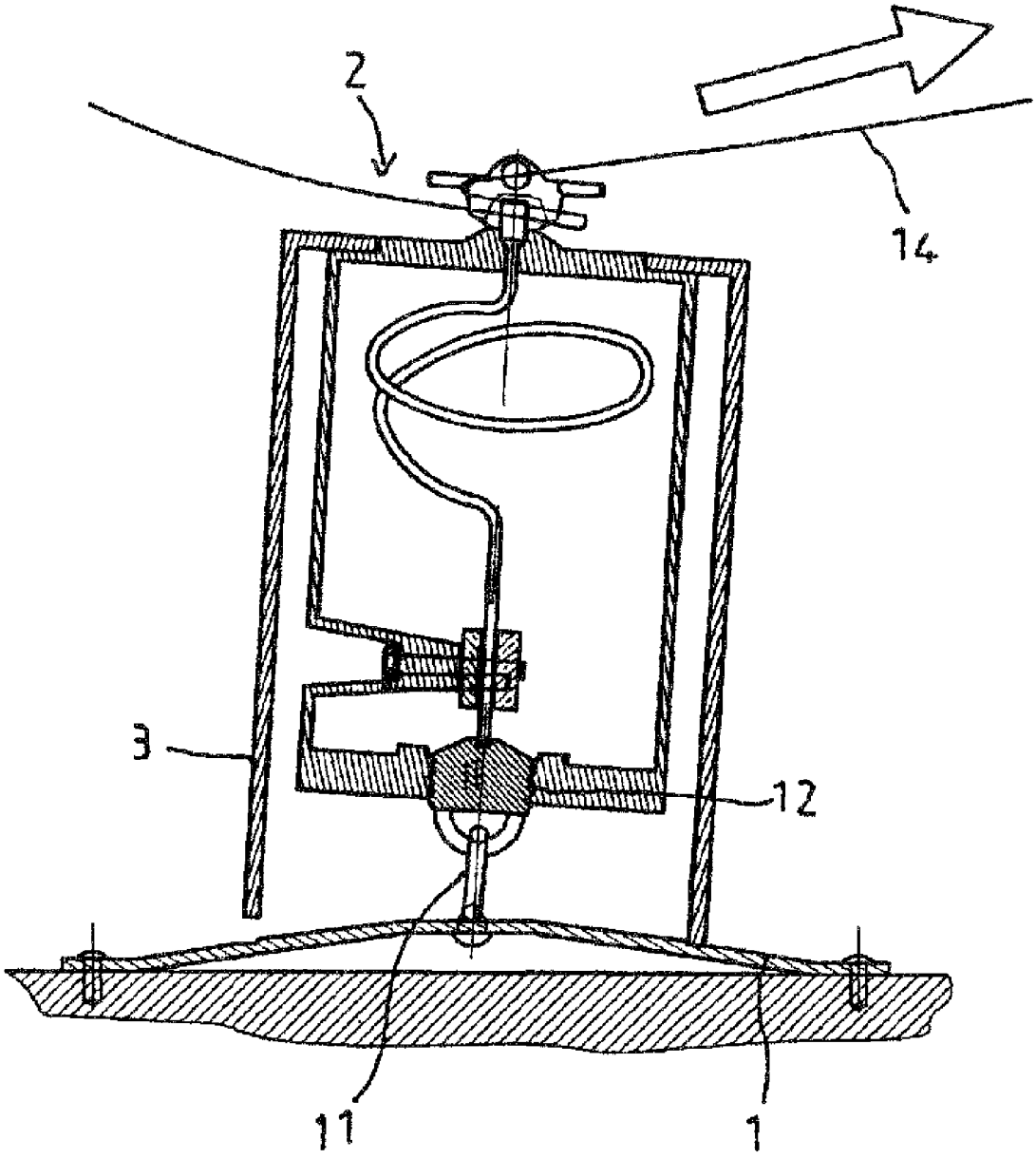
FIGS. 2 to 5 illustrate different operating phases of the invention when subjected to stress through an impact.

In the case of FIG. 2, therefore, an impact is generated and transmitted to the safety fixing system by means of life-line 14, connected to the system by means of connection 2.

At this level, slight tilting of body 3 may occur relative to base 1 because of link assembly 11 allowing such tilting to take place.

In the case of FIG. 2, the force is lower than the predetermined threshold so that threaded connection 12 remains intact.

Figure 3:
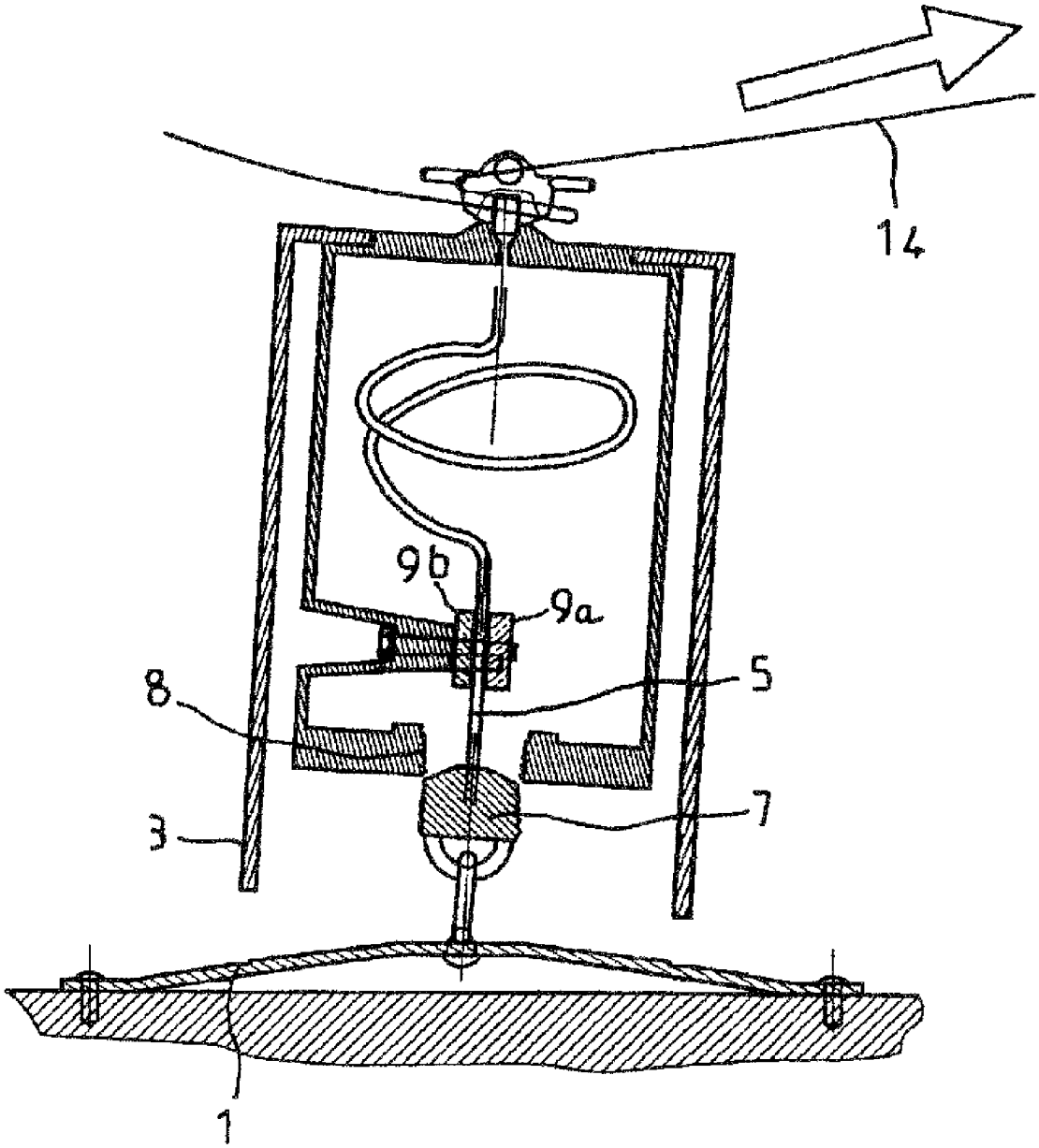

On the other hand, in the case of FIG. 3, the force is such that the threshold is exceeded and threaded connection 12 is torn.

Fuse parts 7 and 8 are then separated, which enables cable portion 5 to be displaced by sliding in jaws 9*a*, 9*b*.

Advantageously, each jaw 9*a*, 9*b* is provided with an inner groove, shown in FIG. 6, to provide good translational guidance of cable portion 5.

Figure 4:
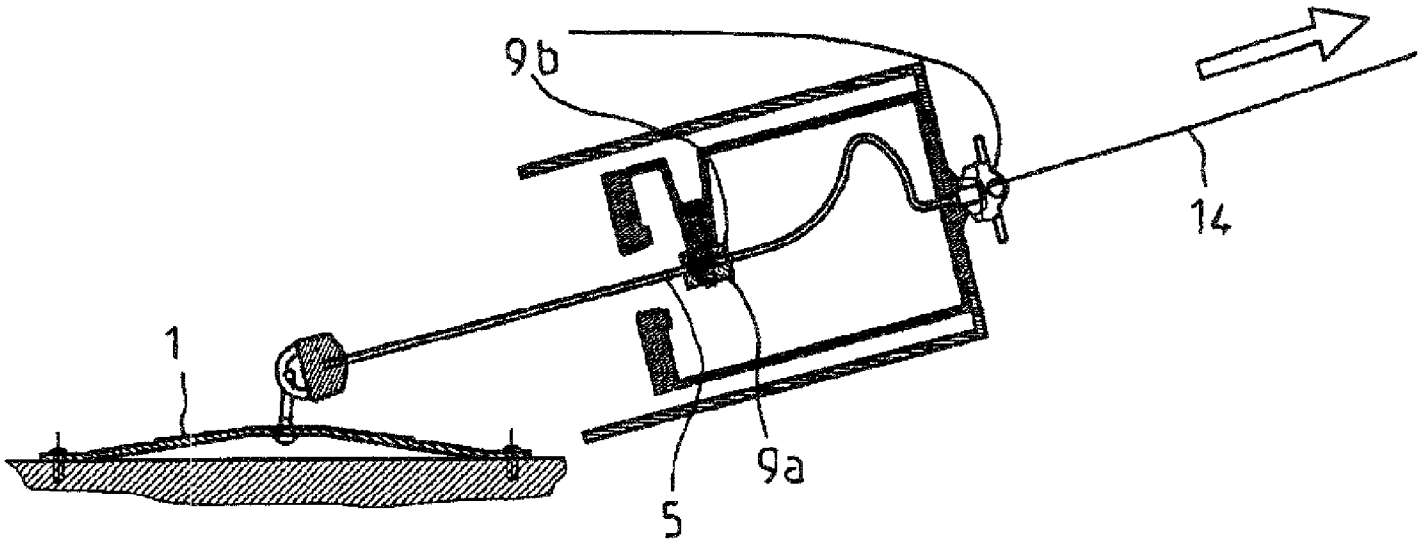
Figure 5:
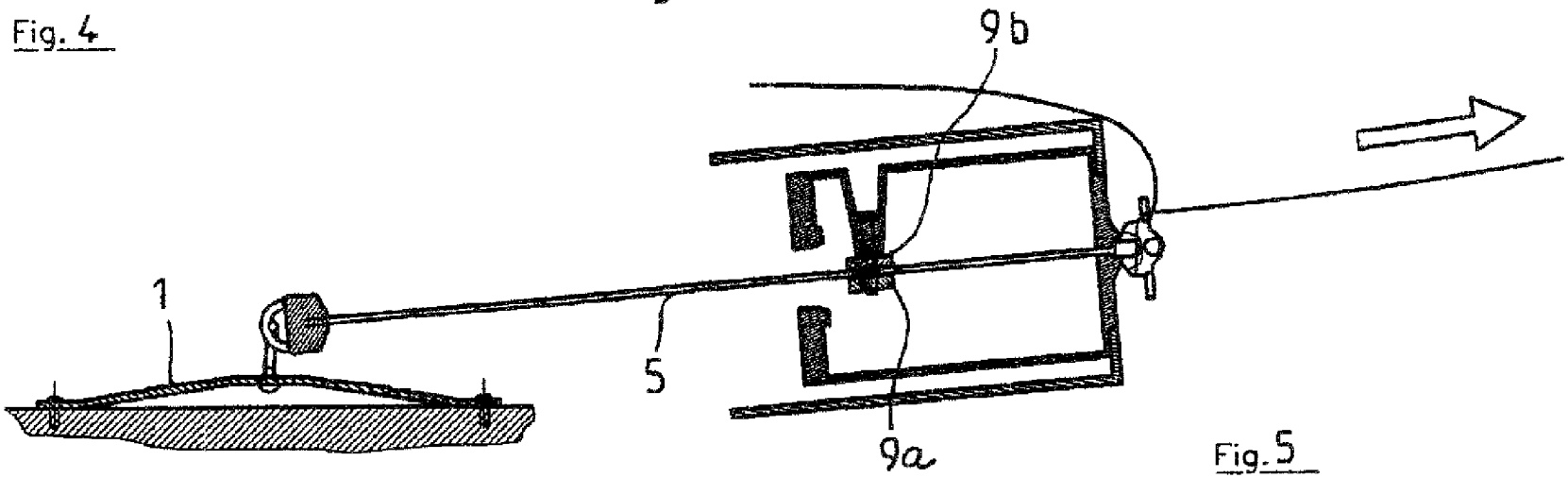

FIGS. 4 and 5 show the progression of the relative movement of cable 5 and jaws 9*a*, 9*b*.

During this movement, the friction generates an energy absorption (to absorb the impact), which also enables the forces acting on the receiving structure to be limited.

The level of damping can easily be adjusted by modifying the force of contact generated by jaws 9*a*, 9*b* on cable portion 5 by screwing or unscrewing screwing means 10*a*, 10*b*.

In the case of FIG. 5, cable portion 5 is fully tensioned, which stops the operation of the energy absorption device.

It will be noted that the fuse means described previously can be used independently of the energy absorption thus presented.

The fuse means are preferably configured so that they can easily be replaced without having to replace the fixing system in its entirety.

In this context, one of parts 7, 8 is advantageously produced in a material that is less tear resistant than the other in order to effect the destruction of the threads of only one of parts 7, 8.

Less resistant threads are preferably formed on part 8, and this part is provided detachably and replaceably on frame 4.

Other configurations, however, fall within the scope of the invention.

In particular, part 7 may be made replaceably in a material that is less resistant than part 8.

REFERENCES

1. Base
2. Means of connection
3. Body
4. Frame
5. Cable portion
6. Ring
7. First fuse part
8. Second fuse part
9*a*, 9*b*. Jaws
10*a*, 10*b*. Screwing means
11. Link assembly
12. Threaded connection
13. Screw

14. Line

15. Reference surface

The invention claimed is:

1. Energy absorption device comprising:

a first section and a second section capable of being set in relative motion with friction to absorb energy, the first section having two jaws capable of being applied on either side of the second section;

a connector coupled to the second section, the connecter further configured to be coupled to a life-line;

a body further coupled to the connector, the first and second sections selectively received in the body; and a fuse for triggering the relative movement of the first and second sections beyond a predetermined force threshold, wherein the fuse includes two threadably connected fuse parts forming a threaded connection, the threaded connection configured to be broken beyond the predetermined force threshold.

2. Device according to claim 1, wherein the two jaws are configured and arranged to adjust the frictional force between the first and second sections by varying a contact force between the first and second sections.

3. Device according to claim 2, further comprising:

a screw engaged with the two jaws to adjust a distance between the two jaws.

4. Device according to claim 1, wherein the second section comprises a cable portion capable of being displaced between the jaws.

5. Device according to claim 4, wherein the jaws are provided with a groove for guiding the cable portion.

6. Device according to claim 1, wherein the two threadably connected fuse parts have different tearing strengths so that the breaking of the threaded connection is due to the tearing of the threads of just one of the two threadably connected parts.

7. Device according to claim 6, wherein the two threadably connected fuse parts are made of materials of a different mechanical strength.

8. Device according to claim 1, wherein at least one fuse part of the two threadably connected fused parts is replaceable.

9. Device according to claim 6, wherein each of the two threadably connected fuse parts has a thread tearing strength, further wherein one of the two threadably connected fuse parts having a lowest tearing strength of its threads is replaceable.

10. An energy absorption system for a life-line, the system comprising:

an anchoring base configured to be coupled on a reference surface;

an elongated flexible first portion having a first end coupled to the anchoring base;

a connector configured to be coupled to the life-line, a second end of the first portion coupled to the connector;

a second portion frictionally engaged with the first portion, the second portion adjustable to adjust the friction between the second portion and the first portion;

wherein the first and second portions are configured and arranged to absorb energy when the first the portion is moved in relation to the second portion; and a fuse coupled to prevent the relative movement of the first and second sections until a predetermined force threshold is exceeded, the fuse including two threadably connected fuse parts that create a threaded connection, the threaded connection configured to be broken when the predetermined force threshold is exceeded.

11. System of claim 10, further comprising:

a body mounted on the base, the first and second portions stored within a receiving volume of the body.

12. System according to claim 11, comprising:

a frame for supporting the second portion, the frame integral with the body and received within the volume of the body.

13. System according to claim 12, further comprising:

a first one of the fuse parts being integral to the first portion proximate the first end of the first portion;

a second one of the fuse parts being integral with the frame.

14. Device according to claim 10, wherein the second portion includes a pair of jaws engaging the elongated flexible first portion.

15. An energy absorbing device, comprising:

a base coupled to a structure;

a cable portion having a first end and second end, the first end of the cable portion coupled to a life-line, the second end of the cable portion coupled to the base;

a body mounted on the base, the body having a receiving volume, the cable portion received in the body when the energy device is an un-activated configuration;

a frame integral with the body, the frame received in the receiving volume of the body;

a friction portion frictionally engaged with the cable portion, the friction portion adjustable to adjust the friction between the friction portion and the cable portion, the friction portion coupled to the frame; and a fuse having a first fuse portion coupled to the frame and a second fuse portion coupled between the second end of the cable portion and the base, the first and second fuse portions having a threaded connection that is configured and arranged to separate due to a force acting relative to the first and second fuse portions that exceeds a predetermined force threshold.

16. The energy absorbing device of claim 15, wherein the friction portion further comprises:

a first jaw;

a second jaw, the first jaw and second jaw configured and arranged to be positioned around a portion of the cable portion; and an adjusting member configured and arranged to adjust a frictional force upon which the first and second jaws exert on the cable portion.

* * * * *